350-332 SR
8/25/81 XR 4,286,328

United States Patent [19]

Bocker

[11] 4,286,328

[45] Aug. 25, 1981

[54] INCOHERENT OPTICAL AMBIGUITY FUNCTION GENERATOR

[75] Inventor: Richard P. Bocker, San Diego, Calif.

[73] Assignee: The United States of America as represented by the Secretary of the Navy, Washington, D.C.

[21] Appl. No.: 949,328

[22] Filed: Oct. 6, 1978

[51] Int. Cl.[3] ..... G06G 7/195; G06G 9/00

[52] U.S. Cl. ..... 364/851; 350/332; 350/DIG. 1; 364/821; 364/822

[58] Field of Search ..... 364/603, 604, 607, 713, 364/726, 819, 820, 821, 822, 826, 827, 851, 861, 837; 350/150, DIG. 1, 332

[56] References Cited

U.S. PATENT DOCUMENTS

| | | | |
|---|---|---|---|
| 3,430,240 | 2/1969 | Loesch | 343/17.2 PC |
| 3,479,494 | 11/1969 | Wilmotte | 364/822 |
| 3,483,557 | 12/1969 | Skenderoff et al. | 364/822 |
| 3,519,331 | 7/1970 | Cutrona | 364/822 |
| 3,526,893 | 9/1970 | Skenderoff et al. | 364/728 |
| 3,827,629 | 8/1974 | Max et al. | 367/726 |
| 3,862,360 | 1/1975 | Dill et al. | 350/322 |
| 4,016,413 | 4/1977 | Bramley | 364/827 |
| 4,123,142 | 10/1978 | Fleming et al. | 364/822 |
| 4,139,897 | 2/1979 | Gardner et al. | 364/822 |

OTHER PUBLICATIONS

Preston Jr.: Computing at the Speed of Light Electronics, Sep. 6, 1965, pp. 72–83.

*Primary Examiner*—Felix D. Gruber
*Attorney, Agent, or Firm*—Richard S. Sciascia; Ervin F. Johnston; Harvey Fendelman

[57] ABSTRACT

An electro-optical system for performing the computation of the radar ambiguity function or other similar mathematical function using the parallel processing capability of optical systems including a photo-responsive, real-time programmable mask for storing a set of sample values $\{s_p\}$. A light source is positioned to illuminate the mask and have its intensity modulated as a function of the sample values $\{s_p\}$. The image from the programmable mask is transferred to a CCD photo-sensor array that is clocked in synchronism with the light pulse outputs of the light emitting diode to give rise to electro-optical products which are integrated in the CCD structure to yield the ambiguity or other similar mathematical function.

12 Claims, 6 Drawing Figures

INCOHERENT OPTICAL AMBIGUITY FUNCTION GENERATOR

BACKGROUND OF THE INVENTION

The concept of the present invention is concerned with the computation of the radar or sonar ambiguity function employing electro-optical techniques and means as well as similar mathematical computations.

There is an increasing tendency to employ sophisticated waveforms using various forms of amplitude, phase, and frequency codings in modern radar technology. Classification schemes presently used in EW measure only the most elementary radar properties such as frequency band, pulse length, pulse repetition rate and scan rate. These characteristics are often sufficient to identify many specific radars by comparison with previously established reference libraries, but they do not allow the deduction of the radar's full capabilities. Therefore, if a radar signal is encountered in the field for the first time, little can be said about the detailed system's capabilities or the countermeasure techniques which would be optimally effective.

The ambiguity function proves to be an indispensable tool for radar and sonar signal designers. If the ambiguity function of an unknown signal could be calculated with a compact system in real time or near real time, a completely unknown radar could be characterized and optimally countered in the field. Prior to the present invention, however, there has been no teaching to verify that the strong potential of an electro-optical approach can be achieved in this case.

The power of optical analog information processing and computing is attributed to the fact that optical systems are capable of processing information in parallel at very high rates with relatively few components but usually with only moderate accuracy. By comparison, electronic processing systems offer high precision but at the expense of complex-sophisticated components that are intrinsically serial in nature. Optical processing systems are usually subdivided into two main categories, coherent and incoherent. Coherent optical systems use coherent light for purposes of information processing. These systems are linear in amplitude and are capable of manipulating both the amplitude and phase of the light disturbance. However, coherent systems are highly sensitive to vibration and therefore must be isolated from the environment in most practical applications. The result is often large, complex systems mounted on granite slabs which can be only employed in a ground-base activity. Incoherent optical processing systems, on the other hand, utilize incoherent light and are linear in intensity. As a result, these systems are more compact in size and weight and can be easily utilized in an environment such as that found aboard ship or aircraft.

Incoherent optical processing systems have been designed in the past, examples of which are illustrated in U.S. Pat. Nos. 3,937,942 and 4,009,380 incorporated herein by reference. The U.S. Pat. No. 3,937,942 describes an electro-optical correlator. The U.S. Pat. No. 4,009,380 describes an electro-optical system for performing a wide variety of matrix-vector multiplications. Neither of these designs, however, can compute the ambiguity function.

Accordingly, it is desirable that the advantageous aspects of electro-optical techniques be availed of to perform the radar or sonar ambiguity function computation or other mathematical computations of a similar form.

SUMMARY OF THE INVENTION

The present invention relates to an electro-optical system for performing the computation of the radar or sonar ambiguity function using the parallel processing capability of optical systems. As previously mentioned, the ambiguity function has proven to be an indispensable tool for both radar and sonar signal designers. For every form of signal s(t), there exists a corresponding ambiguity function $x(\tau,w)$ such that $$x(\tau,w)=\int s(t)s(t-\tau)\cos(2\pi wt)dt \tag{1}$$

where s(t) is the envelope of the signal. For this discussion, it is assumed that s(t) is real and positive. The ambiguity function has several equivalent definitions but this disclosure will only be concerned with the implementation of equation (1). When dealing with sampled data systems, it is appropriate to consider a discrete version of equation (1), namely $$x_{mn}=\sum_{p=-L}^{+L} s_p s_{p-m} f_{pn} \tag{2}$$

where $$f_{pn}=\cos(2\pi pn) \tag{3}$$

The sets of numbers $\{s_p\}$, $\{f_{pn}\}$, and $\{x_{mn}\}$ correspond to the sample values of the functions s(t), $\cos(2\pi wt)$, and $x(\tau,w)$, respectively. It is assumed that the function s(t) takes on non-zero values only over a finite time interval, hence the reason for the finite limits (−L, +L) appearing in equation (2). The sample values $x_{mn}$ in equation (2) can be generated from the sample values $s_p$ using the incoherent optical system of the present invention.

Basically, the system of the present invention is described as follows. A real-time or near real-time photo responsive, programmable mask comprising a plurality of elements is disposed in a matrix of m rows and n columns where each element has a substantially equal resolution area relative to all the other like elements and contains recorded discrete information. Initially, the discrete values of the set $\{s_p\}$ are stored in the programmable matrix. A light source such as a light emitting diode (LED) is positioned to illuminate the mask and means are arranged for temporally modulating the intensity of the light source as a function of the sample value set $\{s_p\}$. In one embodiment disclosed herein the programmable mask operates in the reflection mode so that the amount of light that is scattered from each cell thereof is dictated by the quantity previously programmed therein. The reflected "image" irradiates a fixed transform transparency such as a matrix array of 35 mm film. The amount of light that is transmitted through this fixed transparency is proportional to the mathematical product of the transmission factor programmed into each particular cell of the fixed transparency with the amount of light impinging thereupon. The light spatial pattern emerging from the fixed transparency is then imaged on a CCD photo-detector array. The CCD photo-detector array is clocked in synchronism with the pulses from the aforesaid LED such that subsequent to each LED light pulse the contents of each row of the CCD array are shifted to the succeeding row. The process continues in this manner until all of the sample values $s_p$ have been converted to light photons in the LED. Concurrently, the contents of the CCD array are emptied into a display or other suitable register. After the final LED light pulse, any information still remaining in the CCD array is shifted out into the display register.

In a first alternative embodiment of the present invention, a line array light valve and a cylindrical/spherical lens combination replaces the photo-responsive programmable mask. In a second alternative embodiment of the present invention, a line array of light emitting diodes in combination with programmable tap weightings and a cylindrical/spherical lens combination replaces the photo-responsive programmable mask. Additionally, in this second alternative embodiment, the CCD array may be preprogrammed to have encoded thereon the information recorded on the transform transparency in the first mentioned embodiment.

STATEMENT OF THE OBJECTS OF THE INVENTION

Accordingly, it is a primary object of the present invention to adapt advanced electro-optical techniques to compute the ambiguity function.

A concomitant primary object of the present invention is to adapt advanced electro-optical techniques for extremely high-speed, reliable, and accurate computation of mathematical functions of the form described in equation (2) above.

Another object of the present invention is to facilitate the employment of electro-optical techniques through the use of advanced electro-optical components to perform complex mathematical procedures.

These and other features, objects and advantages of the present invention will be better appreciated from an understanding of the operative principles of the preferred embodiment as described hereinafter and as illustrated in the accompanying drawings.

DESCRIPTION OF THE PREFERRED EMBODIMENTS

Figure 1:
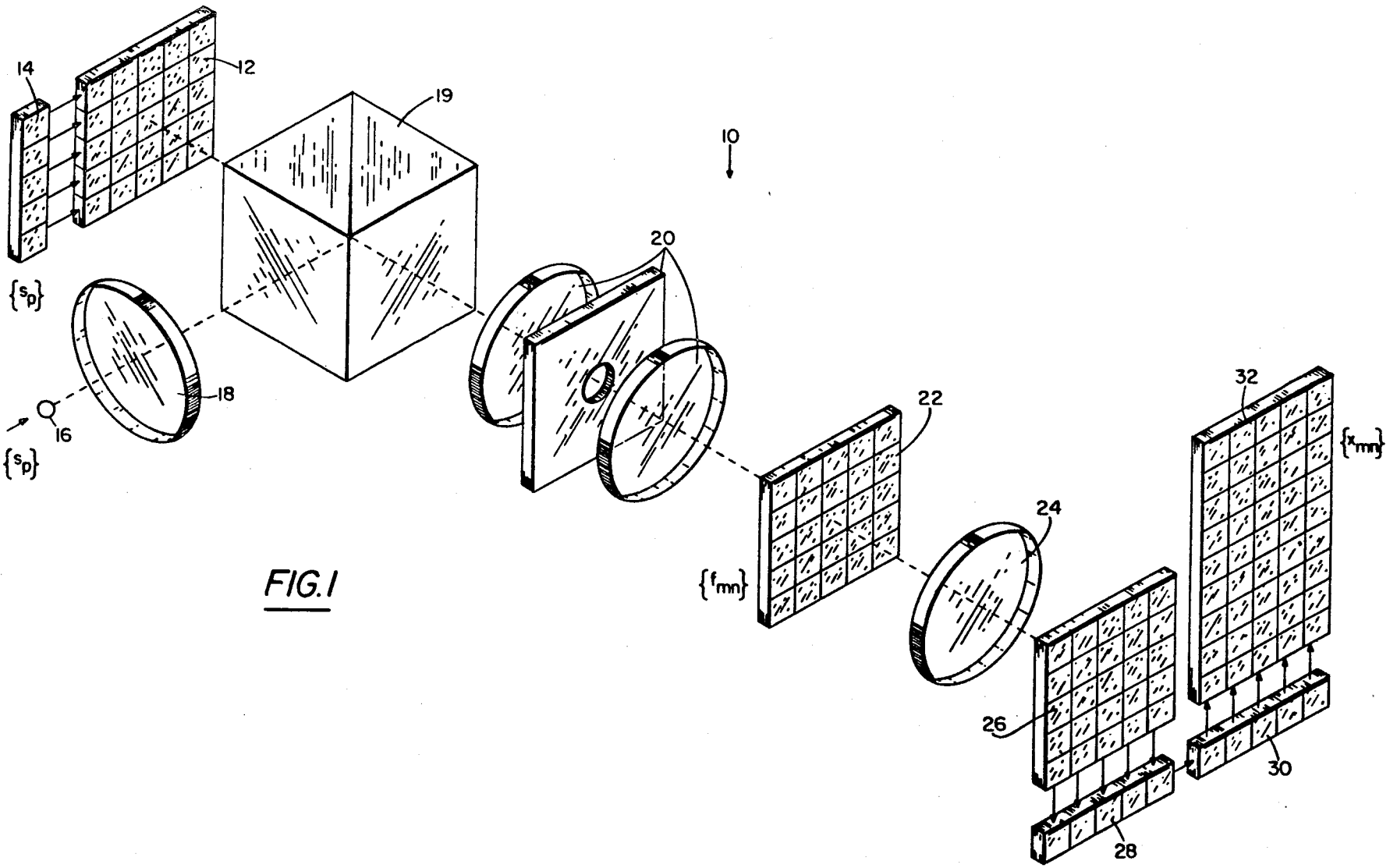
FIG. 1 is a schematic layout of an embodiment of the electro-optical ambiguity function generator of the present invention.

Referring now to FIG. 1 the embodiment therein will be described. The system 10 contains a real-time programmable mask 12. For example, a 100×100 matrix addressed liquid crystal light valve as described in U.S. Pat. No. 3,862,360 (incorporated herein by reference) could be employed hereat. In this embodiment, the photo-responsive programmable mask 12 is used in a reflection mode. Serial-to-parallel converter 14 is connected to the mask 12 for loading the mask 12 with the sample values from the set $\{s_p\}$.

Light emitting diode 16 comprises a source of incoherent light energy which is adapted to be responsive to modulated electrical input signals for producing a commensurately modulated light energy output. Condensing lens 18 receives the light energy output of the source 16 for transmission through beam splitter 19 to thereby irradiate the mask 12. A contrast control aperture and lens arrangement 20 is required for optional masks which perform in a scattering mode of operation as does the aforementioned liquid crystal light valve. It is noted hereat that the nature of the light valve 12 is not critical to the present invention. The light valve may be either of the transmitting type or the reflecting type so long as it has the capability of being encoded with the sample values $\{s_p\}$.

The light energy reflected (or transmitted) by the mask 12 is transmitted through the beam splitter 19, the contrast control aperture 20 and through a transform transparency mask 22. The mask 22 contains the optically recorded information representing the mathematical values constituting the set $\{f_{mn}\}$. The mask 22 may comprise a photographic optical transparency such as 35 mm film. Imaging lens 24 transmits the light energy output of the transform transparency 22 to the area array charge coupled device (CCD) 26. Parallel-to-serial converter 28 processes the CCD output for reception by the serial-to-parallel converter 30. The information output of converter 30 may then be displayed on a suitable display means 32.

Figure 2:
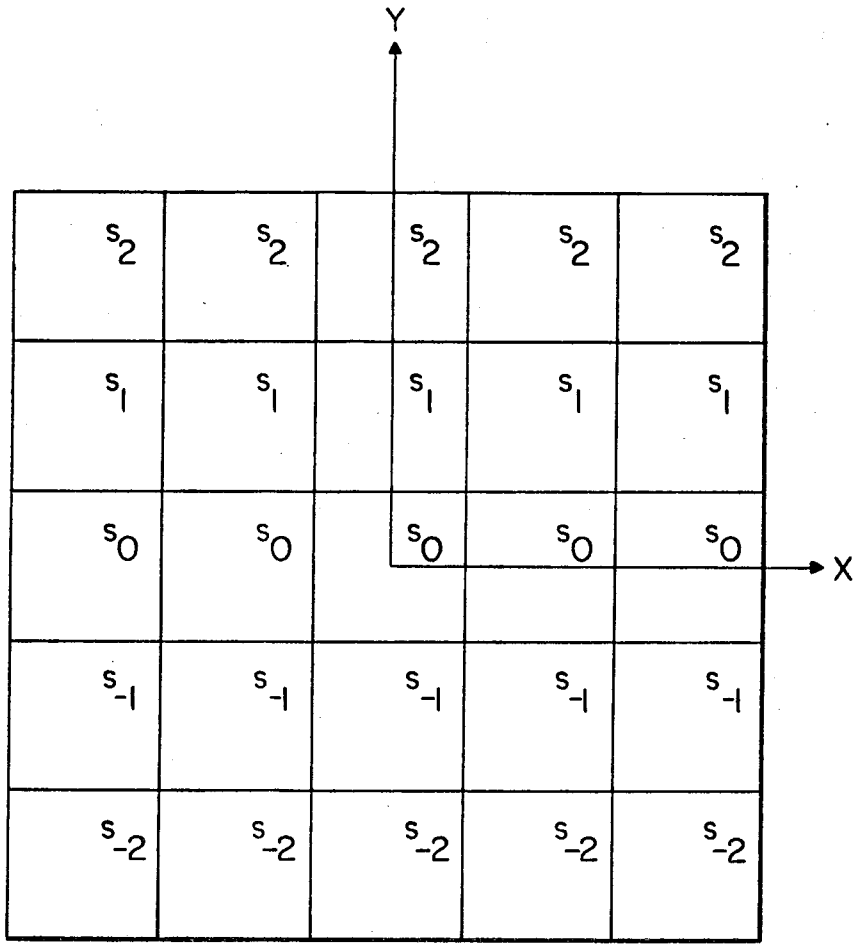
FIG. 2 is a schematic diagram of the format in which the programmable mask of FIG. 1 is encoded.

The operation of the embodiment illustrated in FIG. 1 will now be described. Assuming that an analog temporal signal s(t) must be sampled and then transformed according to equation (2) into its corresponding discrete ambiguity function representation, this description will proceed by tracing s(t) through the system from input to output. The first step in preparing the analog input signal s(t) for processing is to convert it to its discrete version $\{s_p\}$. This can be done by passing the signal s(t) through a form of sample and hold circuit. For example, the sampled values $\{s_p\}$ could be stored temporally in a mini-computer or other memory where at a later time this information could be fed into the proposed processor. The first step in computing the associated ambiguity function is to take the resulting set of sampled values given by $$\{s_p\}=\{s_{-L}, \ldots, s_{-2}, s_{-1}, s_0, s_1, s_2, \ldots, s_L\} \tag{4}$$

and store them in the matrix addressed liquid crystal light valve 12 in a format as depicted in FIG. 2. The reflectance function of the light valve after $\{s_p\}$ has been encoded is given by the following equation:

$$R(x,y) = c_1 \sum_{n=-L}^{+L} \sum_{p=-L}^{+L} s_p \,\mathrm{rect}\left(\frac{x-nW_x}{W_x}\right)\mathrm{rect}\left(\frac{y-pW_y}{W_y}\right). \tag{5}$$

$W_x$ and $W_y$ correspond to the linear dimensions of each cell in the light valve 12 in the x and y dimensions, respectively. $c_1$ is a constant of proportionality. The function rect(x) is defined by $$\mathrm{rect}(x) = \begin{cases} 1 & |x| < \frac{1}{2} \\ 0 & |x| > \frac{1}{2} \end{cases}$$

Once the information $\{s_p\}$ has been encoded in the light valve 12, the next step in the process is to feed this same information into the LED 16. Ideally, the LED 16 and condensing lens 18 are configured in a manner such that the light beam incident on the light valve 12 (via the beam splitter 19) has a uniform irradiance distribution over the beam diameter, which varies in time according to $$I(t) = c_2 \sum_{l=-L}^{+L} s_l \,\mathrm{rect}\left(\frac{t + l\Delta t}{T}\right) \tag{6}$$

where the sample value $s_l$ corresponds to the height of the $l^{th}$ square pulse, $\Delta t$ the spacing between pulses, and T the pulse duration ($T \leqq \Delta t$). $c_2$ is a constant of proportionality which depends on the design of the condensing optics and on the scale of the electrical-to-optical pulse conversion by the LED 16 and its electronics.

Figure 3:
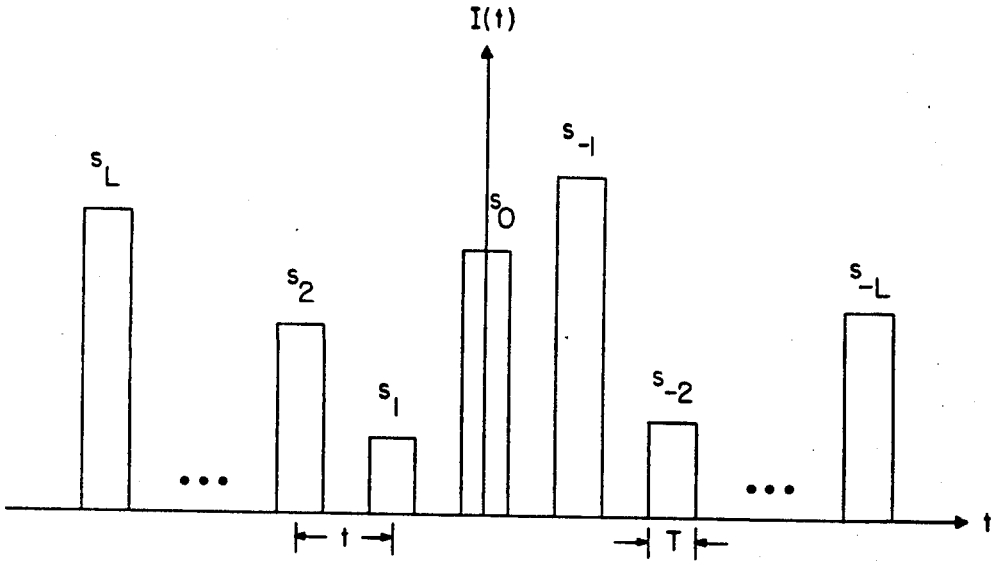
FIG. 3 is a graph of an exemplary irradiance distribution from the LED of FIG. 1.

FIG. 3 depicts a signal I(t). After reflection from the light valve 12, the irradiance distribution at the transform transparency 22 plane is $$E(x,y;t) = c_3 R(x,y) I(t) \tag{7}$$

where $c_3$ is a scale factor which accounts for the effect of the contrast control aperture 20 on the light field.

Figure 4:
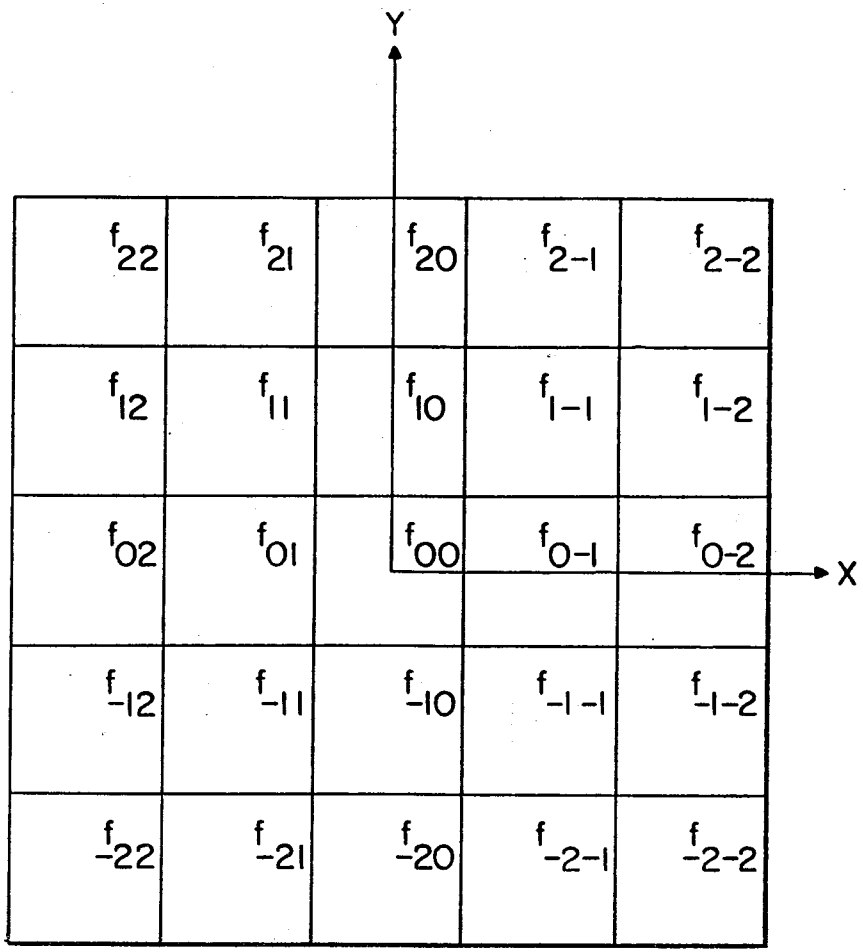
FIG. 4 is a schematic illustration of an exemplary format suitable for encoding the fixed transparency of FIG. 1.

The transform transparency 22 has encoded upon it the transform kernel information $\{f_{pn}\}$ as depicted by way of example in FIG. 4. It is noted that for the purpose of computing the ambiguity function, the quantities for computing $f_{pn}$ are given by equation (3). However, $f_{pn}$ could take on other values if required to give the system 10 a more general computational capability. The transmittance function associated with the optical transform transparency is given by $$\tau(x,y) = c_4 \sum_{n=-L}^{+L} \sum_{p=-L}^{+L} f_{pn} \,\mathrm{rect}\left(\frac{x - nW_x}{W_x}\right) \mathrm{rect}\left(\frac{y - pW_y}{W_y}\right). \tag{8}$$

For simplicity a one-to-one magnification between the light valve 12, transform transparency 22, and CCD detector planes 26 has been assumed. $c_4$ is a constant of proportionality. Thus, the irradiance distribution incident on the detector plane 26 is $$E'(x,y;t) = c_5 E(x,y;t) \tau(x,y) \tag{9}$$

where $c_5$ is a proportionality constant which takes into account losses induced by the imaging lens 24. With the use of Eqs. (5) through (8), Eq.(9) can be written in the form $$E'(x,y;t) = c\left[\sum_{n=-L}^{+L} \sum_{p=-L}^{+L} s_p f_{pn} \,\mathrm{rect}\left(\frac{x - nW_x}{W_x}\right) \mathrm{rect}\left(\frac{y - pW_y}{W_y}\right)\right] \left[\sum_{l=-L}^{+L} s_l \,\mathrm{rect}\left(\frac{t + l\Delta t}{T}\right)\right] \tag{10}$$

where $$c = c_1 c_2 c_3 c_4 c_5. \tag{11}$$

The optically sensitive region of the area-array CCD 26 consists of a rectangular array of identical rectangular photosensors. These CCD elements, each of size $W_x$ by $W_y$ are arranged on an array the same size and scale as the optical mask. It is noted that any mismatch between the sizes of the light valve array 12, transform transparency 22, and CCD array can be compensated for by the imaging optics. The energy entering the $(p,n)^{th}$ element of the CCD due to the $1^{th}$ LED 16 pulse is $$\epsilon_{pnl} = c s_1 s_p f_{pn}. \tag{12}$$

The resulting charge content of each CCD cell in the $n^{th}$ column is transferred laterally down, by one element between LED 16 pulses, and the stored photocharge in the $(p,n)^{th}$ element due to the $1^{th}$ pulse is added to the charge stored in the $(p+1,n)^{th}$ element due to the $(1+1)^{st}$ pulse, and so on. The net effect is that the $m^{th}$ packet of charge which is shifted out of the $n^{th}$ column contains a quantity of charge given by $$Q_{mn} = ck \sum_{p=-L}^{+L} s_p s_{p-m} f_{pn}. \tag{13}$$

k is a proportionality constant which takes into account the quantum efficiency of the conversion of light to electrical energy in the CCD device 26. The expression for $Q_{mn}$ in Eq.(13) is proportional to the desired quantity $x_{mn}$ given by Eq.(2). These charge packets can now be horizontally clocked out (via a shift register) and displayed on suitable display device 32.

Figure 5:
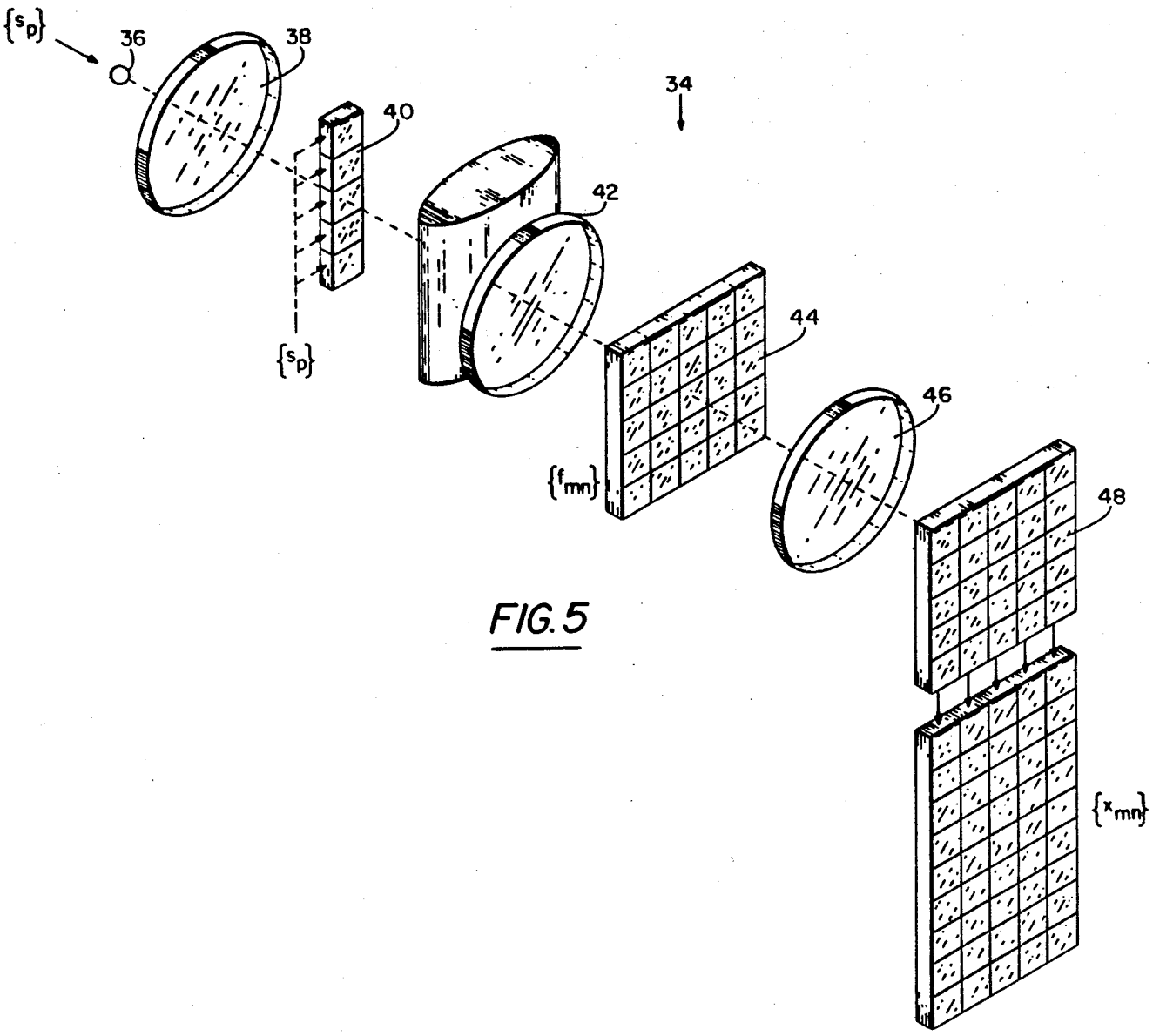
FIG. 5 is a schematic layout of a first alternative embodiment of the present invention.

Referring now to FIG. 5 there is illustrated an alternate embodiment of the present invention. The system 34, like the system illustrated in FIG. 1 comprises a light emitting diode 36 and a condensing lens 38. In this embodiment, however, a line array light valve 40 is used in combination with a cylindrical/spherical lens combination 42. As in the embodiment illustrated in FIG. 1, the light valve 40 is programmed prior to computation with the discrete values $\{s_p\}$. The use of the cylindrical/spherical lens combination 42 eliminates the need of a two-dimensional array format light valve such as 12 in FIG. 1. The lens combination 42 serves to spread out the light that is transmitted through the light valve 40 so that the irradiation from the line array 40 appears as though it originated from a two-dimensional array. The transform transparency 44, the imaging lens 46, and the CCD array 48 are analogous to the light components illustrated in FIG. 1 and, therefore, need no further description. The line array light valve 40 could be, for example, a PLZT (lead lanthanum zirconate titanate) linear array page composer or an acousto-optic traveling wave modulator. The CCD array 48 may also have provision for clocking out the information contained therein in parallel. This, of course, would allow for increased processing speeds and eliminate the bottleneck of a parallel-to-serial and serial-to-parallel converter as are illustrated in FIG. 1.

Figure 6:
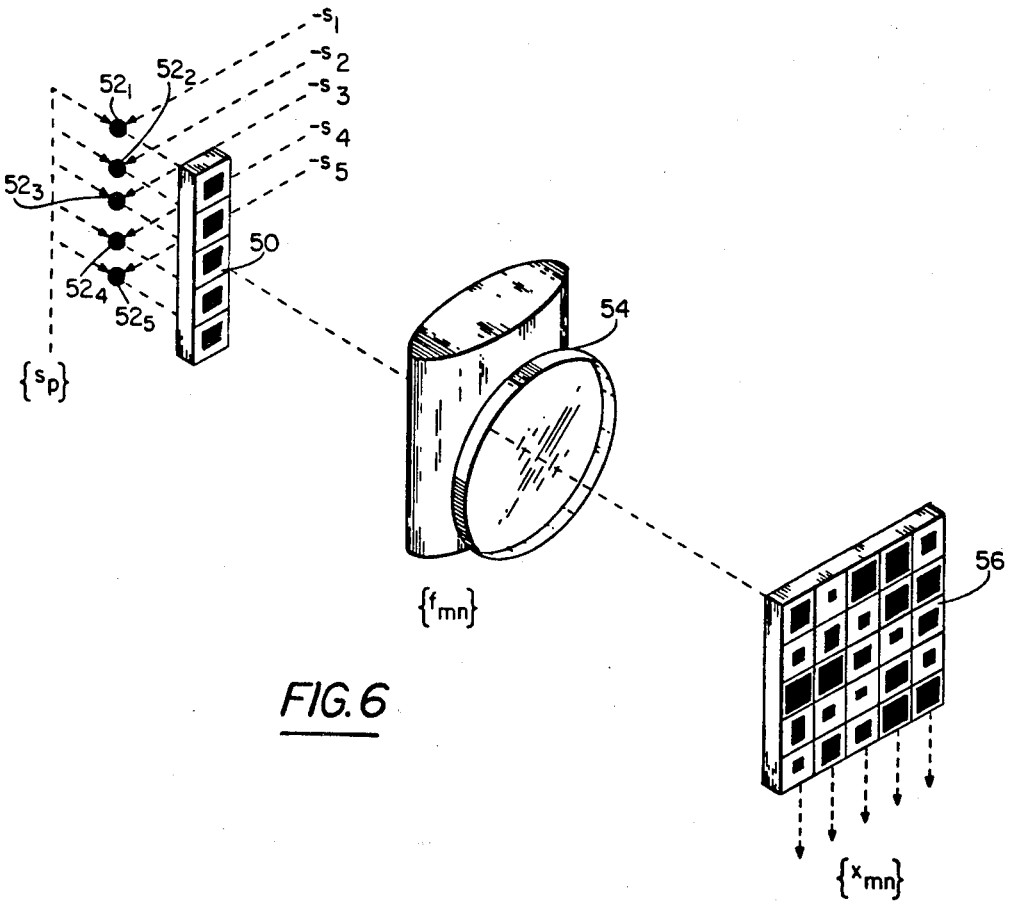
FIG. 6 is a schematic layout of a second alternative embodiment of the present invention.

Referring now to FIG. 6 there is illustrated a second alternate embodiment of the present invention. Here, the light emitting diode 16, the condensing lens 18, the light valve 12 and beam splitter 19 of FIG. 1 are all replaced by a line array of light emitting diodes 50, each such LED having associated therewith a programmable weighting tap $52_1$, $52_2$, $52_3$, $52_4$, and $52_5$. Additional taps would, of course, be required where additional LED's in array 50 are used. The weighting taps 52 serve as the mechanism for pre-programming the values $\{s_p\}$. Cylindrical/spherical lens combination 54 functions to spread out the irradiation from line array 50 so that the light output of 54 simulates the irradiance from a two-dimensional array and thereby enables the use of the simpler line array 50. CCD 56 could have the fixed transform transparency information $\{f_{pn}\}$ actually encoded on it and thus eliminate the need for the imaging optics 46 as well as the fixed transform transparency 44. Recently RCA fabricated a CCD (512 rows×326 columns) chip which contained such fixed mask information. The mask information encoded on the CCD chip can be accomplished as a final step in the CCD chip fabrication by depositing chrome, using photoetching techniques, at each CCD detection element site of a specified amount in terms of area coverage. The chrome reflects impinging light, thereby reducing the quantity of photodetection occurring at the CCD site. By properly controlling the size of the area covered by the chrome, the fixed information representative of the sample values $\{f_{pn}\}$ can be encoded onto the CCD array 56.

Obviously many modifications and variations of the present invention are possible in the light of the above teachings. It is therefore to be understood that within the scope of the appended claims the invention may be practiced otherwise than as specifically described.

What is claimed is:

1. An electro-optical system for computing the mathematical function of the discrete sample form $$x_{mn} = \sum_{p=-L}^{+L} s_p s_{p-m} f_{pn}$$

where $\{s_p\}$ and $\{x_{mn}\}$ are sets of numbers representing sampled values of the functions s(t) and x(τ,w), respectively comprising:

a photo-responsive programmable mask for storing said sampled values of $\{s_p\}$ of the signal s(t);

a light source positioned to illuminate said photo-responsive programmable mask;

said light source being responsive to input signals for temporally modulating the intensity of the output of said light source as a function of the said values $\{s_p\}$;

a photographically recorded mask having encoded thereon information representative of the values $\{f_{pn}\}$;

an imaging lens positioned for transmitting light radiated by said photographically recorded mask;

a photo-sensor array positioned to be illuminated by the irradiance from said imaging lens.

2. The system of claim 1 wherein said photo-sensor array comprises a CCD photo-sensor area array.

3. The system of claim 1 wherein said programmable mask comprises a matrix addressed liquid crystal light valve.

4. The system of claim 1 wherein said programmable mask comprises a line array light valve;

said system further comprising a cylindrical/spherical lens positioned to be illuminated by the light transmitted by said line array light valve.

5. The system of claim 1 wherein said light source comprises:

a light emitting diode;

a condensing lens; and a beam splitter positioned to irradiate said programmable mask with the light output of said light emitting diode.

6. The system of claim 5 wherein said programmable mask comprises a matrix addressed liquid crystal light valve.

7. The system of claim 6 including a contrast control aperture positioned to be irradiated by the light output of said beam splitter.

8. The system of claim 7 wherein said light source generates incoherent light energy.

9. An electro-optical system for computing a mathematical function of the form $$x_{mn} = \sum_{p=-L}^{+L} s_p s_{p-m} f_{pn}$$

where $\{s_p\}$ and $\{x_{mn}\}$ are sets of numbers representing sampled values of the functions s(t) and x(τ,w), respectively, comprising:

a line array of light emitting diodes;

a programmable weighting tap operably-coupled to each element of said line array of light emitting diodes;

a cylindrical/spherical lens combination positioned to be illuminated by said light emitting diodes; and an optical CCD array having encoded thereon fixed information representative of the values $\{f_{pn}\}$ disposed to be irradiated by the light energy passing through said cylindrical/spherical lens combination.

10. An electro-optical system for computing the mathematical function of the discrete sample form $$x_{mn} = \sum_{p=-L}^{+L} s_p s_{p-m} f_{pn}$$

where $\{s_p\}$ and $\{x_{mn}\}$ are sets of numbers representing sampled values of the functions s(t) and x(τ,w), respectively comprising:

a photo-responsive programmable mask for storing said sampled values of $\{s_p\}$ of the signal s(t);

a light source positioned to illuminate said photo-responsive programmable mask;

said light source being responsive to input signals for temporally modulating the intensity of the output of said light source as a function of the said values $\{s_p\}$;

a photographically recorded mask having encoded thereon information representative of the values $\{f_{pn}\}$;

a contrast control aperture assembly positioned between said light source and said photographically recorded mask;

an imaging lens positioned for transmitting light radiated by said photographically recorded mask;

a photo-sensor array positioned to be illuminated by the irradiance from said imaging lens.

11. The system of claim 5 wherein said light source further comprises a contrast control aperture positioned to be irradiated by the light output of said beam splitter.

12. An electro-optical system responsive to a source of light for computing the mathematical function of the discrete sample form $$x_{mn} = \sum_{p=-L}^{+L} s_p s_{p-m} f_{pn}$$

where $\{s_p\}$ and $\{x_{mn}\}$ are sets of numbers representing sampled values of the functions s(t) and x(τ,w), respectively, comprising:

a photo-responsive programmable mask for storing said sampled values of $\{s_p\}$ of the signal s(t);

a photographically recorded mask having encoded thereon information representative of the values $\{f_{pn}\}$;

an imaging lens positioned for transmitting light transmitted by said photographically recorded mask; and a photo-sensor array positioned to be illuminated by the transmitted light from said imaging lens.

* * * * *